United States Patent [19]

Sukow

[11] Patent Number: 4,845,852

[45] Date of Patent: Jul. 11, 1989

[54] HAIR TRIMMER WITH ADJUSTABLE COMB

[75] Inventor: Daniel L. Sukow, Grafton, Wis.

[73] Assignee: Andis Company, Racine, Wis.

[21] Appl. No.: 225,629

[22] Filed: Jul. 27, 1988

Related U.S. Application Data

[63] Continuation of Ser. No. 112,914, Oct. 23, 1987.

[51] Int. Cl.[4] ..... B26B 19/20

[52] U.S. Cl. ..... 30/201; 30/132; 30/233.5

[58] Field of Search ..... 30/131–133, 30/200–202, 208, 233, 233.5, 293

[56] References Cited

U.S. PATENT DOCUMENTS

| | | | |
|---|---|---|---|
| 1,311,935 | 8/1919 | White | 30/201 |
| 2,006,493 | 7/1935 | Andis | 30/201 |
| 2,184,981 | 12/1939 | Suozzi | 30/201 |
| 3,979,825 | 9/1976 | Baumann | 30/201 X |
| 4,219,931 | 9/1980 | Vacillotto | 30/133 |
| 4,314,405 | 2/1982 | Park | 30/133 |

*Primary Examiner*—Frank T. Yost
*Assistant Examiner*—Michael D. Folkerts
*Attorney, Agent, or Firm*—Michael, Best & Friedrich

[57] ABSTRACT

A hair trimmer comprising a main body including a cylindrical portion having an axis, a blade set located in axially spaced relation from the cylindrical portion, and a non-cylindrical portion located between the blade set and the cylindrical portion, a ring disposed on the cylindrical portion and rotatably movable relative thereto, a comb disposed on the non-cylindrical portion of the main body and including a non-cylindrical portion cooperating with the non-cylindrical portion of the main body to permit displacement of the comb along the axis relative to the blade set and to prevent relative rotation between the comb and the main body, and structure connecting the ring with the main body and with the comb for displacing the comb axially relative to the main body in response to rotation of the ring.

12 Claims, 2 Drawing Sheets

HAIR TRIMMER WITH ADJUSTABLE COMB

CROSS REFERENCE TO RELATED APPLICATION

This is a continuation of a co-pending application Ser. No. 112,914 filed Oct. 23, 1987, abandoned.

FIELD OF THE INVENTION

The invention relates generally to hair trimmers and to combs which are attachable to such hair trimmers to assist the user in cutting hair to a particular length.

BACKGROUND OF THE INVENTION

In the past, different sized combs were used to facilitate cutting hair at different lengths. Thus, the user of a hair clipper changed combs to facilitate cutting hair at different lengths.

SUMMARY OF THE INVENTION

A principal feature of the invention is to provide a hair trimmer with a comb which can be adjusted relative to a blade set to facilitate cutting hair at varying lengths.

More particularly, the invention provides a hair trimmer comprising a main body including a cylindrical portion having an axis, a blade set located in axially spaced relation from the cylindrical portion, and a non-cylindrical portion located between the blade set and the cylindrical portion, a ring disposed on the cylindrical portion and rotatably movable relative thereto, a comb disposed on the non-cylindrical portion of the main body and including a non-cylindrical portion cooperating with the non-cylindrical portion of the main body to permit displacement of the comb along the axis relative to the blade set and to prevent relative rotation between the comb and the main body, means on the ring and on the main body for preventing axial movement therebetween, and means on comb and on the ring for displacing the comb axially on the main body in response to rotation of the ring.

In one embodiment, the means for preventing axial movement between the ring and the main body is releasable and includes an annular groove on one of the main body and the ring and a tab on the other of the main body and the ring, which tab is movable into and out of the groove.

In one embodiment, the means on the ring and on the comb comprises a helical track on one of the ring and the comb and a projection extending from the other of the ring and the comb and received in the track.

In one embodiment, the track is on the inside of the ring and the comb includes a sleeve extension located between the ring and the main body and the projection extends outwardly from the sleeve extension and is received in the track.

In one embodiment, the ring and the main body include detent means for affording feel of the rotary position of the ring relative to the main body.

Other features and advantages of the invention will become apparent to those skilled in the art upon review of the following detailed description, claims, and drawings.

IN THE DRAWINGS

Figure 4:
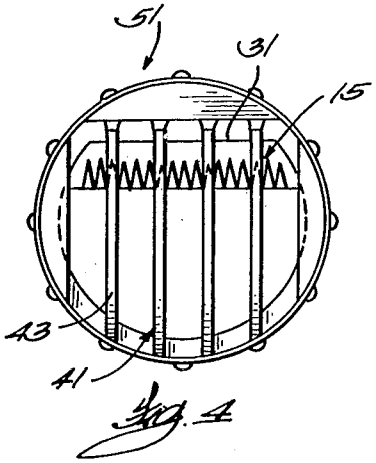
FIG. 4 is an end view of the hair trimmer shown in FIG. 1.

Before one embodiment of the invention is explained in detail, it is to be understood that the invention is not limited in its application to the details of construction and the arrangements of components set forth in the following description or illustrated in the drawings. The invention is capable of being carried out in various ways. Also, it is to be understood that the phraseology and terminology used herein is for the purpose of description and should not be regarded as limiting.

GENERAL DESCRIPTION

Shown in the drawings is a hair trimmer 11 including an elongated handle or main body 13 having, at one end thereof, a blade set 15 which can be of any conventional construcction. Included in the handle or main body 13 is any suitable means (not shown) for activating the blade set 15 to permit hair cutting.

The main body or handle 13 includes a cylindrical portion 21 which is spaced from the blade set 15 in the direction of the length of the handle 13 and which has an axis 23 extending in the direction of handle elongation. The cylindrical portion 21 forms a part of a generally cylindrical section extending from the blade set 15 to a shoulder 25 forming an end of a handle portion 27 of the handle or main body 13. The cylindrical portion 21 has a diameter greater than the transverse length of the blade set 15.

The main body or handle 13 also includes a non-cylindrical portion 31 located between the cylindrical portion 21 and the blade set 15. While other constructions could be employed, in the illustrated construction, such non-cylindrical portion 31 comprises a flat 33 formed in the otherwise cylindrical outline of the non-cylindrical portion 31.

The hair trimmer 11 also includes a comb 41 which includes a comb portion 43 which is located adjacent the blade set 15 and which can be of any suitable construction, and a non-cylindrical sleeve portion 47 which extends from the comb portion 41 and which has an internal non-circular cross-section mating with the non-circular cross-section of the non-cylindrical portion 31 of the main body or handle 13 so as to afford movement of the comb 41 along and lengthwise of the main body or handle 13, or in the direction of the axis 23, to adjustably locate the comb portion 43 relative to the blade set 15 and to prevent relative rotation between the comb 41 and the main body or handle 13.

The hair trimmer 11 also includes a ring 51 which is located in encircling relation to the cylindrical portion 21 and which is rotatable relative thereto.

Means are also provided on the hair trimmer 11 for additionally connecting the ring 51 to the main body or handle 13 and to the comb 41 for displacing the comb 41 axially or lengthwise of the main body or handle 13 in response to rotation of the ring 51.

Figure 1:
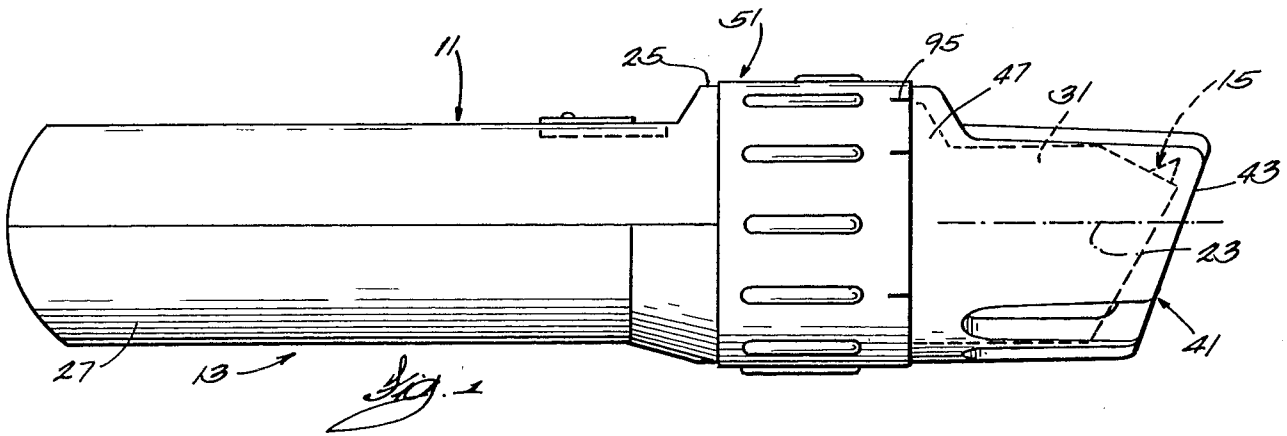
FIG. 1 is a side elevational view of a hair trimmer which embodies various of the features of the invention and which is shown with a comb in retracted position.
Figure 8:
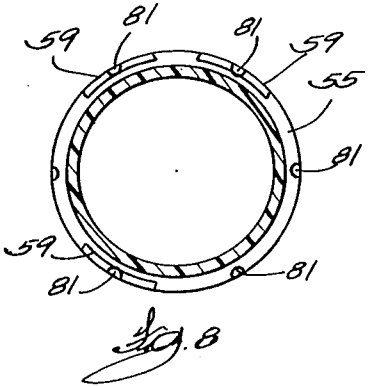
FIG. 8 is a sectional view taken along line 8—8 of FIG. 3 and with parts omitted.
Figure 2:
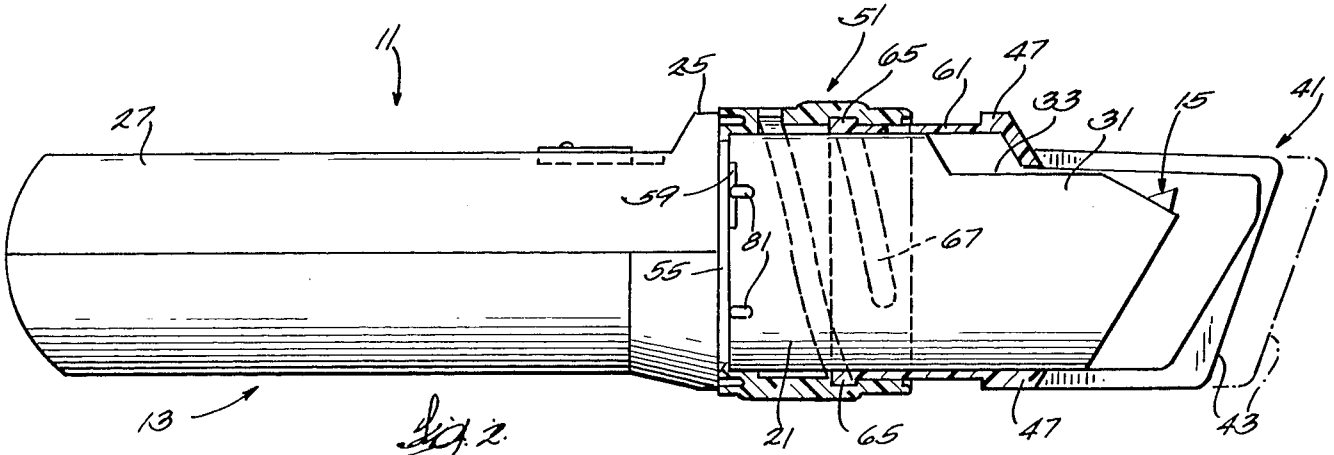
FIG. 2 is a view similar to FIG. 1 but partially in section and with the comb in fully extended position.
Figures 3, 5, 6, 7:
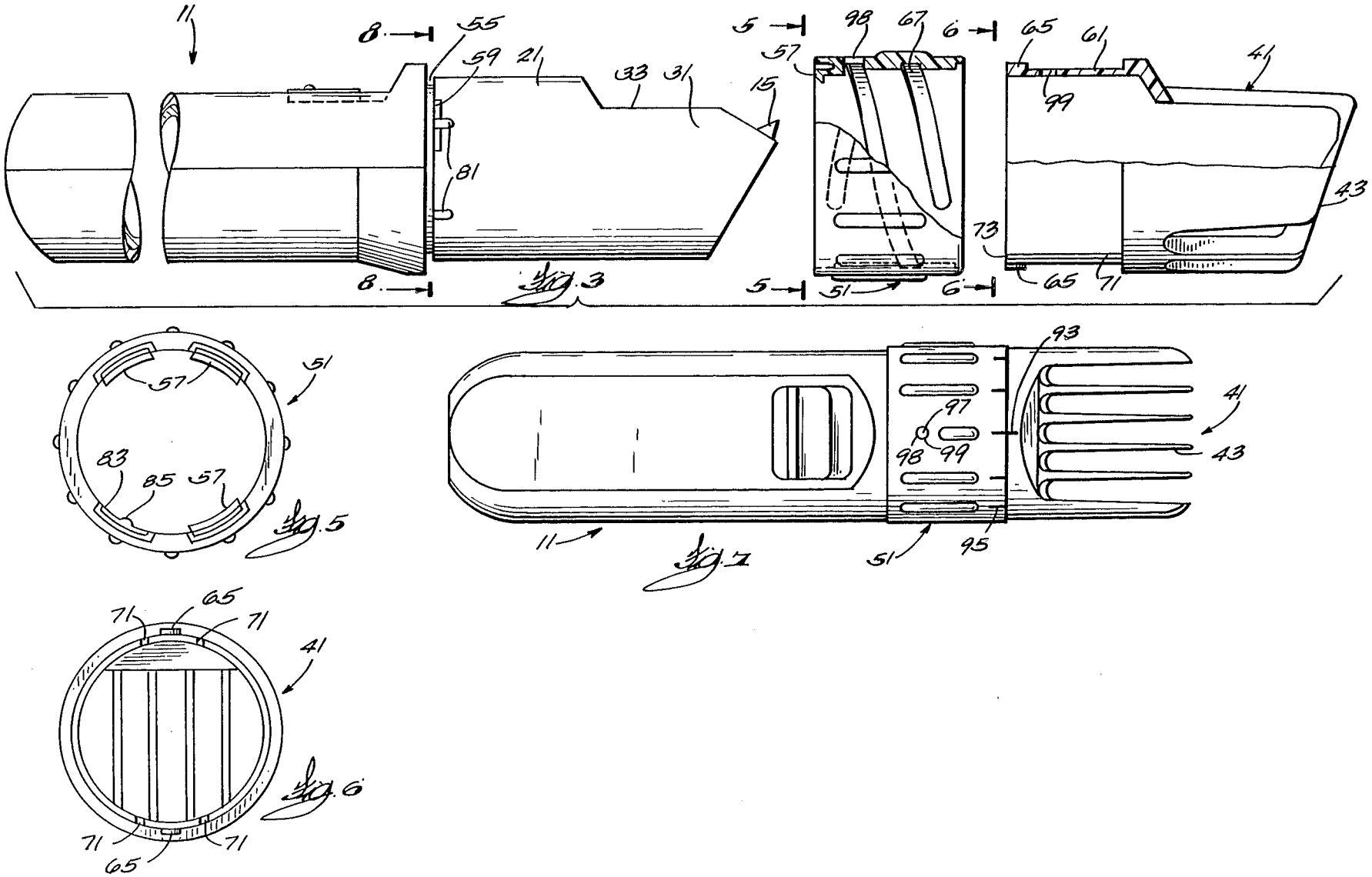
FIG. 3 is an exploded view of the main components of the hair trimmer shown in FIG. 1, with portions thereof broken away and in section.
FIG. 5 is an end view taken along line 5—5 of FIG. 3.
FIG. 6 is an end view taken along line 6—6 of FIG. 3.
FIG. 7 is a top view on a reduced scale of the hair trimmer shown in FIG. 1.

While other constructions could be employed, in the construction shown in FIGS. 1 through 8 the ring 51 is connected to the main body or handle 13 to releasably prevent axial displacement of the ring 51 relative to the main body or handle 13, while permitting relative rotation therebetween, and the ring 51 and the comb 41 are releasably connected to permit relative rotation therebetween and to effect axial displacement of the comb 41 relative to the ring 51 in response to rotation of the ring 51.

While other constructions could be employed, in the illustrated construction, the means connecting the ring 51 and the main body or handle 13 comprises a circumferential groove 55 located in the main body or handle 13 adjacent the shoulder 25, and one or more resilient tabs 57 which are integrally formed on the ring 51, at one end thereof, and which are displaceable radially outwardly to facilitate, during assembly of the ring 51 on the main body or handle 13, telescopic movement of the ring over the blade set 15 and over the non-cylindrical portion 31 of the main body 13 and along the cylindrical portion 21 of the main body 13 until the tabs 57 snap into the groove 55 to prevent axial movement between the ring 51 and the main body or handle 13. However, if a sufficient force is applied to the ring 51 in the direction to telescopically withdraw the ring 51 from the handle 13, such force will cause withdrawal of the tabs 57 from the groove 55 to permit withdrawal of the ring 51 from the main body 13. Preferably, the cylindrical portion 21 includes, for each of the tabs 57, a ramp 59 which extends from the groove 55 and facilitates withdrawal of the tabs 57 from the annular groove 55. It is preferred that the tabs 57 extend inwardly from the ring 51 so as to provide a radial space between the tabs 57 and the end of the ring 51 and so that the presence of the resilient tabs 57 is hidden from view. In addition, it is preferred that the tabs 57 have a snap action when engaging in the groove 55 in order to provide an audible noise indicating proper receipt of the ring 51 on the cylindrical portion 21.

While other constructions could be employed, in the illustrated construction, three such tabs 57 are employed.

While other constructions could be employed, in the illustrated construction, the means connecting the ring 51 and the comb 41 includes, on the comb 41, a sleeve extension 61 which projects from the non-cylindrical sleeve portion 47, and which is rotatably received on the cylindrical portion 21 of the main body or handle 13 underneath the ring 51. At least one radially outwardly extending projection 65 (two in the disclosed construction) is provided on the sleeve extension 61 for receipt in a pair of helical grooves or threads or tracks 67 on the inner surface of the ring 51. The helical grooves or tracks 67 are closed at both ends to limit axial travel of the comb 41 relative to the ring 51 by reason of engagement of the projections 65 with abutting surfaces at the closed ends of the tracks 67.

In order to facilitate receipt of the projections 65 in the grooves or tracks 67, the sleeve extension 61 is fabricated with a relatively thin wall and includes at least one elongated slot 71 extending from the free end 73 of the sleeve extension 61. Four such slots 71 are employed in the disclosed construction. The slots 71 afford resilient collapse of the sleeve extension 61 to a smaller dimension to facilitate insertion of the sleeve extension 61 into the ring 51 and location of the projections 65 into the helical grooves or tracks.

Consequently, rotation of the ring 51 relative to the main body or handle 13 causes axial displacement of the comb 41 relative to the main body or handle 13 and to the blade set 15 to afford adjustable positioning of the comb portion 43 relative to the blade set 15.

The hair trimmer 11 also includes means for sensing the rotary position of the ring 51 relative to the main body or handle 13 and therefore the axial position of the comb portion 43 relative to the blade set 13. While other constructions could be employed, in the disclosed construction, the cylindrical portion 21 includes a series or plurality of angularly spaced detents or recesses 81 located adjacent to and, if desired, in communication with the annular groove 55 and the ring 51 is provided, at the end adjacent the shoulder 25, with another resilient tab 83 which is resiliently radially outwardly displaceable and which includes thereon a projection 85 located for selective engagement or receipt into the recesses 81 to provide a feel for the angular location of the ring 51. One of the projection 85 and the plurality of recesses 81 is designed to facilitate withdrawal of the projection 85 from the engaged recess 81 in response to a somewhat increased torque applied to the ring 51 during rotation thereof. Preferably, the construction provides a snap action so that, in addition to feel, an audible noise is produced to indicate engagement of the projection 85 into the recesses 81.

In addition, if desired, the ring 51 can be provided with indicia 95 which can be compared to a mark in the form of an axial line 93 on the comb 41 to visually indicate the axial location of the comb portion 43 relative to the blade set 15.

If desired, in order to assist disassembly or withdrawal of the ring 51 from the main body, the cylindrical portion 21 can be provided with a colored dot 97 and the ring 51 and comb 41 provided with repective apertures or windows 98 and 99 which, when aligned with the dot, indicate to the user that the tabs 57 are aligned with the ramps 59 which afford withdrawal of the ring 51 from encircling relation to the cylindrical portion 21. Preferably the tabs 57 are located in alignment with the ramps 59 when the comb 41 is in its most retracted condition, i.e., when the non-cylindrical sleeve portion 47 is adjacent the ring 51.

Various of the features of the invention are set forth in the following claims.

I claim:

1. A hair trimmer comprising a main body including a cylindrical portion having an axis, a blade set located in axially spaced relation from said cylindrical portion, and a non-cylindrical portion located between said blade set and said cylindrical portion, a ring disposed on said cylindrical portion and rotatably movable relative thereto, a comb disposed on said non-cylindrical portion of said main body and including a non-cylindrical portion cooperating with said non-cylindrical portion of said main body to permit displacement of said comb along said axis relative to said blade set and to prevent relative rotation between said comb and said main body, means on said ring and on said main body for preventing axial movement therebetween, and means on said comb and on said ring for displacing said comb axially of said main body in response to rotation of said ring.

2. A hair trimmer in accordance with claim 2 wherein said means for preventing axial movement between said ring and said main body is releasable and includes an annular groove on one of said main body and said ring and a tab on the other of said main body and said ring, said tab being movable into and out of said groove.

3. A hair trimmer in accordance with claim 2 wherein said groove is in said main body and said tab is on said ring and is resiliently biased for movement into said ring.

4. A hair trimmer in accordance with claim 3 wherein said ring includes a plurality of said tabs.

5. A hair trimmer in accordance with claim 1 wherein said means on said ring and on said comb comprises a helical track on one of said ring and said comb and a projection extending from the other of said ring and said comb and received in said track.

6. A hair trimmer in accordance with claim 5 wherein said track is on the inside of said ring and wherein said comb includes a sleeve extension located between said ring and said main body and said projection extends outwardly from said sleeve extension and is received in said track.

7. A hair trimmer in accordance with claim 6 wherein said track has closed ends to limit axial movement of said comb relative to said ring.

8. A hair trimmer in accordance with claim 1 wherein said comb includes a comb portion extending from one end of said non-circular portion, and a sleeve extension extending from the other end of said non-circular portion and located between said ring and said main body.

9. A hair trimmer in accordance with claim 8 wherein said sleeve extension has free end and including a slot extending axially from said free end.

10. A hair trimmer in accordance with claim 1 wherein said ring and said main body include detent means for affording feel of the rotary position of said ring relative to said main body.

11. A hair trimmer in accordance with claim 10 wherein said detent means includes a series of angularly spaced recesses on one of said ring and said main body and a projection extending from the other of said ring and said main body, said projection being selectively and releasably engageable with said recesses.

12. A hair trimmer in accordance with claim 10 wherein said projection is on said ring and said recesses are in said main body.

* * * * *